US010794081B2

(12) United States Patent
Ash

(10) Patent No.: US 10,794,081 B2
(45) Date of Patent: Oct. 6, 2020

(54) FENCE RAIL WITH CONCEALED FASTENER AND ANTI-RATTLING CAPABILITIES

(71) Applicant: Justin Jay Ash, Hemet, CA (US)

(72) Inventor: Justin Jay Ash, Hemet, CA (US)

( * ) Notice: Subject to any disclaimer, the term of this patent is extended or adjusted under 35 U.S.C. 154(b) by 445 days.

(21) Appl. No.: 15/372,001

(22) Filed: Dec. 7, 2016

(65) Prior Publication Data

US 2017/0167161 A1 Jun. 15, 2017

Related U.S. Application Data

(60) Provisional application No. 62/265,257, filed on Dec. 9, 2015.

(51) Int. Cl.
*E04H 17/14* (2006.01)

(52) U.S. Cl.
CPC ..... *E04H 17/1421* (2013.01); *E04H 17/1443* (2013.01); *E04H 2017/1478* (2013.01); *E04H 2017/1491* (2013.01)

(58) Field of Classification Search
CPC ..... E04F 2011/1819; E04F 2011/1821; E04H 17/1421; E04H 17/1426; E04H 17/1439; E04H 17/1443; E04H 2017/146; E04H 2017/1478; F16B 2/243; F16B 7/0446; F16B 7/0473; Y10T 403/7176; Y10T 403/7194
USPC ..... 256/22, 24, 65.02, 65.03, 65.08, 65.11, 256/65.12; 403/397, 400
See application file for complete search history.

(56) References Cited

U.S. PATENT DOCUMENTS 2,520,725 A * 8/1950 Judd ..... E05C 19/06 174/371
3,156,282 A * 11/1964 Bedford, Jr. ..... F16B 37/041 411/103
5,556,079 A 9/1996 West
5,660,378 A 8/1997 Schall
6,131,354 A * 10/2000 Thompson ..... E05C 19/006 248/208
6,375,166 B1 4/2002 Schall et al.
7,152,849 B2 * 12/2006 Graber ..... E04H 17/1443 256/22
7,635,115 B2 12/2009 Lehmann
7,819,390 B2 * 10/2010 Godwin ..... E04H 17/1443 256/65.02
8,177,195 B2 * 5/2012 Schall ..... F16B 7/0446 256/22
8,413,332 B2 4/2013 Duffy et al.
8,833,737 B2 * 9/2014 Langenwalter ..... E04H 17/1426 256/67

(Continued)

OTHER PUBLICATIONS

PCT International Search Report for International Patent Application No. PCT/US2017/012003, dated Jul. 21, 2017, 4 pages.

(Continued)

*Primary Examiner* — Josh Skroupa
(74) *Attorney, Agent, or Firm* — Greenspoon Marder LLP; Justin F. McNaughton

(57) ABSTRACT

A clip with a T-Keeper which fits into a slot in a picket, and bent edges that apply even and constant pressure to the inside of a rail. The T-Keeper member is inserted into a picket and rotated, and then then picket with the clip are inserted through an opening in a rail, thereby securing the picket to the rail.

9 Claims, 8 Drawing Sheets

(56) References Cited

U.S. PATENT DOCUMENTS

| | | | | |
|---|---|---|---|---|
| 9,027,909 | B1 | 5/2015 | Peyton et al. | |
| 9,435,134 | B2 * | 9/2016 | Walmsley | E04H 17/1439 |
| 9,695,612 | B2 * | 7/2017 | Batts, III | E04H 17/1439 |
| 2005/0127344 | A1 | 6/2005 | Graber | |
| 2010/0044662 | A1 | 2/2010 | Walmsley | |
| 2011/0150566 | A1 | 6/2011 | Schall et al. | |
| 2013/0181179 | A1 | 7/2013 | Langenwalter et al. | |
| 2013/0264532 | A1 * | 10/2013 | Goodman | E04H 17/1439 256/65.08 |

OTHER PUBLICATIONS

PCT Written Opinion for International Patent Application No. PCT/US2017/012003, dated Jul. 21, 2017, 8 pages.

* cited by examiner

FENCE RAIL WITH CONCEALED FASTENER AND ANTI-RATTLING CAPABILITIES

CROSS REFERENCE TO RELATED APPLICATIONS

This application claims the benefit of U.S. Prov. Pat. App. No. 62/265,257 filed on Dec. 9, 2015, the entirety of which is hereby incorporated by reference.

BACKGROUND OF THE INVENTION

Field of the invention: This invention relates to the general field of fences, and more specifically toward a fence rail with concealed fastener that allows for both racking of the fence on slopes and minimizing the rattling that occurs with the prior art methods of making rackable fences. To briefly summarize the invention, a clip is used to apply constant pressure between rails and pickets such that a fence panel or section can be "racked" up or down a slope smoothly, efficiently, and without any "rattling" as is found in the prior art.

Fences are constructed with vertical "pickets" and horizontal "rails", usually pre-set in a "fence panel" that is 4 feet, 5 feet or 6 feet high and often 8 feet long, although fence panels of just about every height and length have been created. The rails are basically U-shaped pieces of metal with a solid top, two sides and an open bottom. The tops of rails have square or rectangular holes through which the picket is placed.

When fences are placed on flat ground, the pickets and rails can be permanently locked at 90 degree angles to one another, and you can build a fence by attaching one fence panel after another. But, when trying to place a fence on a slope, the challenge is how to attach the rails to the picket so that a) the fence can be "racked" for a slope, and b) the fence does not rattle due to loose connections between the picket and the rails. You can custom build each fence panel to have vertical pickets and rails angled at just the right angle, but this is (relative to this invention) extremely expensive and time-consuming. You can also put the pickets in at a 90 degree angle to the sloped ground, but this will result in a horrible-looking fence and require you to find some custom pieces to fill in the gaps where a sloped surface meets a flat surface and vice versa.

Instead, it is highly desirable for a fence panel to "rack", that is, the rails and pickets rotate in conjunction with each other such that the pickets remain vertical, but the rails "slope" parallel to the slope of the land. This allows a fence builder to buy the correct number of fence panels, and just "rack" the ones on slopes to contour the fence over the curves of the land. However, the challenge has been how to allow racking without a) poor-looking construction, b) ineffective performance, c) breakage during construction, d) breakage over time, and e) "rattling" and other sounds made by fence panels where there are temporary or permanent gaps between the rails and pickets.

While screws have been used in the past to connect pickets to rails, and the pickets and rails to a certain extent can "rotate", screws are a far-from-ideal means to accomplish the desired goal of an easily rackable panel that doesn't rattle. First, screws are unsightly and require holes to be drilled in both pickets and rails. Second, screws can strip the threads, resulting in a free ranging picket and rail with an unsightly hole in the middle. Third, screws do not apply consistent pressure on both the picket and the rail, so there is rattling. Fourth, screws have a tendency to "back out" or become loose.

The pickets in this invention have notches in them in locations where a rail is to be placed. It should be noted that this invention works with any of the commercially available rails. The picket notch is only cut on one side of the picket, and is only wide enough to insert part of a clip called the "T-keeper" portion. A user inserts the T-keeper into the picket notch, then rotates it 90 degrees so the T-keeper "locks" the clip to the picket.

The picket has a picket notch at every location at which a rail will be attached, then the picket is pushed through holes in the rail. The clip also has two bent edges which fit on either side of the picket. When inserted into the rail, these bent edges will apply a constant pressure against the inside of the rail, thereby allowing smooth racking and preventing rattling. Because the bent edges "snap" into place above the lip of the bottom of the rail, the picket cannot move down through the hole in the rail, thereby locking the rail and the picket together.

As the clip is slid into the interior of the bottom of the "U" in the rail, the T-keeper and the two bent edges are in the shape of a triangle. When the bent edge passes under the rail lip, it starts to build pressure between the rail and the bent edge. This causes the clip to turn to the path of least resistance on the pivot of the T-keeper, thereby allowing the clip to align with the inner surface of the side of the rail to ensure a smooth "snapping" between the picket, the rail and the clip.

As the clip snaps into place, the bent edges create a plane of pressure on the picket by pressing it against the inner side of the rail. While this can be accomplished with only one clip, it is contemplated as part of this invention that two, or ever more clips could be used with each point of attachment between a picket and a rail. Because the cross section of the picket is a square with flat sides, the pressure exerted by the bent edges allows the picket to only rotate in a plane, and prevents the "rattling" that can occur with the prior art.

Because the picket and rail are rotatably locked together, the fence panel can now be "racked" such that it can go up a hill or down a hill. The pickets remain vertical, and because the clip exerts a constant pressure between the picket and the rail, the rotation necessary for racking is consistent, smooth, and results in none of the rattling associated with the prior art.

Since most rails have the same "U-shaped" construction, the clip can be used to connect pickets to a variety of currently available brands of rails. Thus, even a user who buys more than one type of rail from a "close-out" sale can construct a fence that is rackable and yet rattle-free.

Fences have been around for thousands of years. From delineating ownership of land to corralling animals, fences play an important role in everyday life. Because of the large demand for fences, there is a great need for versatile fencing materials that produce aesthetically pleasing fences. Construction of the fence should occur quickly and at minimal cost.

To this end, the prior art teaches fences made of extrudable material, such as aluminum. The materials are cheap and the parts of the fence can be manufactured with little cost. In one embodiment, a fence is created using posts, two or more rails, and a plurality of pickets. The posts are vertically secured to the ground, and the rails are horizontally secured between the posts. The pickets are then vertically secured to the one or more rails. In fence applications where the underlying ground is not level, the rails may be at an angle between posts, whereby the fence is racked as a parallelogram with the pickets remaining parallel with the posts.

There are, however, significant deficiencies in the prior art disclosures. Known designs have exposed fasteners on one side of the rail, an internal clip, a structurally fastened member inside of the rail, or a two or three sided top cover that snaps over the entire rail. These designs are unsightly, expensive to manufacture, expensive to construct, tend to rattle in the wind, susceptible to environmental elements, and/or not suitable for a variety of terrains.

For example, U.S. Pat. No. 7,635,115 to Lehmann teaches a fence rail assembly comprising an extruded rail having a lengthwise slot for receiving a plurality of fasteners for attaching the rail to a plurality of pickets. While the fastener that secures the picket to the rail is hidden, the fastener is secured to the middle of the rail therefore making it unsuitable for a variety of terrains, and is susceptible to environmental elements, such as rain and dust.

Other known fences or railings either have exposed fasteners that must face your home or your neighbor, or have a concealed fastener that causes rattle in the wind and prohibits the panels from being racked to steep hillsides. Racking a fence is where the rails substantially follow the slope of the terrain while the pickets and posts remain vertical. There are also other designs that rely on a fastening member to hold the picket inside the rail. These designs may use a wire or rod that rides inside a channel formed into the extrusion. In these designs, the punch through the top of the rail is the only member keeping the picket from sliding freely on the rail. Relying on the punch to keep the picket from sliding causes the panel to bind up when attempting to rack steep hillsides as well as rattle in the wind. Some existing concealed fastener designs also use a non-replaceable captive rubber gasket to inhibit rattle. However, these gaskets are exposed to the weather and wear out with time, which causes future rattle. Existing concealed fastener designs also use a multi-channel design, which increases cost of production.

The tendency of many of the prior art fence designs to rattle in the wind and during construction is an important detriment to those designs being used in commerce. For fence contractors, a fence section that rattles appears cheap and causes immediate concerns over whether the rails and pickets will stay attached to one another as there is obviously some "play" in the system. There is also concern that if the fence rattles while being constructed one of the connectors could break or somehow otherwise cease to function, thereby ruining that section of fence and causing the contractor to have to remove that section and replace it with another. Since some fences built on slopes—where racking is required for a quality end product—require specific lengths of fence, having to remove a section and replace it with another could delay the project. A contractor more concerned with finishing the job rather than creating an effective fence could drill a hole through the picket and rail and try to screw the rail to the picket, but that would re-create the exact situation that rackable fences have been trying to avoid: an external object that is not spring loaded is expected to keep the picket and rail forced together such that the rail moves in plane parallel to the movement of the picket. Screws and pop-rivets have already proven ineffective in meeting this goal, as they can break or rust easily, and even if they remain "in place", they exert no constant pressure to hold the picket and rail together.

Thus there has existed a long-felt need for a fence panel constructed of pickets and rails with concealed fasteners that is aesthetically pleasing, inexpensive to manufacture, simple to use, and the rails and pickets must allow for racking to track over uneven terrain, such as steep inclines. Further the fence rails should securely fasten the picket to the rail, thereby limiting rattle, as well as withstand variable environmental elements to render a reliable produce with a long usable life.

SUMMARY OF THE INVENTION

The current invention provides just such a solution by having a clip that creates a constant pressure between the rail and the picket such that the rail and picket may rotate to allow racking, but do so in parallel planes such that racking can be done efficiently, smoothly, and without any resulting rattling or other obnoxious or concerning noises.

It is an object of the invention to provide a simple, inexpensive, and efficient means by which rails and pickets can be rotatably connected.

It is another object of the invention to provide a clip that can be easily constructed from simple sheet metal.

It is a further object of this invention to provide a fence panel that can rack without rattling.

It is an additional object of this invention to provide a fence that is relatively inexpensive to manufacture.

It is yet another object of the invention to provide a fence that is relatively easy to construct.

It is a further object of the invention to provide a fencing system that allows for a large number of profiles to be created from a minimum number of unique parts.

Another object of the invention is to provide a clip that can be used to rotably connect pickets to a variety of existing, commercially manufactured rails, such that the invention can be even used to construct fence panels from more than one brand of rail.

It is an additional object of the invention to provide a fence that has a single clip to simplify manufacturing and construction.

The term T-Keeper, as used herein, is a member or protrusion that extends outward from a main body that has a narrow neck portion where it attaches to the main body and a wider head portion on its opposite side, thereby forming a "T" shape. Particular embodiments provide for the head portion having a width that is at least twice the width of the neck portion.

The phrases "picket slot cut" or "picket slot punch" refer to a scribe cut in the picket that provides for the clip to slide or move along the axis of the rail inside the picket. This allows the focal point of the clip to change position along the axis of the rail, thereby providing for superior rackability.

The term dimple refers to an embossment or depression that results in a bulge with rounded sides. Thus, when a dimple extends towards a particular direction, it is the bulge of the dimple that extends towards that particular direction.

Particular embodiments of the current disclosure provide for a fence panel comprising a rail, where the rail comprises two sides and a top web, where the top web additionally comprises a rail hole, at least one of the two sides additionally comprises a lip, and where the two sides each have an outer surface and an inner surface; a picket, where the picket has a picket length and a picket width, and additionally comprising a picket slot cut; a clip, where the clip comprises a main body, a protruding member, and two bent edges, where the protruding member has a narrow neck portion and a wide head portion, where the protruding member is secured to the main body by its neck portion; where the two bent edges are attached to a bottom portion of the main body; where the protruding member of the clip mates with the picket slot cut, where the picket is pushed through the rail hole such that the progress of the picket is stopped by the top edge of the clip, and where the bent edges of the clip exert an amount of pressure against an inner surface of the rail. The fence panel further comprises a plurality of additional pickets and a plurality of additional clips, where each of the plurality of additional pickets is identical to the picket, where each of the plurality of additional clips is identical to the clip, and the plurality of additional pickets is secured to the rail by the plurality of additional clips. The fence panel further comprises two posts, where each end of the rail is secured to one of the two posts. The protruding member of the clip extends away from the main body of the clip at an angle of ninety degrees. The head portion of the protruding member has a width that is at least twice a width of the neck portion. The bent edges of the clip are angled away from the main body of the clip at an angle of between twenty degrees and forty-five degrees, inclusive, or more particularly, the two bent edges of the clip are angled away from the main body of the clip at 27.3 degrees.

Another embodiment of the current disclosure is a clip for securing a picket to a rail comprising a main body, a protruding member, and two bent edges; where the protruding member has a narrow neck portion and a wide head portion, where the protruding member is secured to the main body by its neck portion, where the protruding member extends away from the main body; where the two bent edges are attached to a portion of the main body, where the two bent edges are angled away from the main body. The protruding member extends away from the main body at an angle of ninety degrees. The head portion of the protruding member has a width that is at least twice a width of the neck portion. The two bent edges are angled away from the main body at the same angle. The two bent edges are angled away from the main body at an angle of between twenty degrees and forty-five degrees, inclusive, and more particularly between twenty-five degrees and thirty degrees, inclusive, and even more particularly at 27.3 degrees. The edges of the main body are rounded.

An additional embodiment of the current disclosure is a method of securing a picket to a rail comprising the steps of inserting a protruding member of a clip into a picket slot cut of the picket, where the clip comprises a main body, the protruding member, and two bent edges, where the protruding member has a narrow neck portion and a wide head portion, where the protruding member is secured to the main body by its neck portion; where the two bent edges are attached to a bottom portion of the main body; rotating the clip ninety degrees; and pushing the picket and the clip through an opening in the rail. The rail comprises two sides and a top web, where the top web comprises the rail hole. The progress of the picket is stopped by the top edge of the clip when pushing the picket and the clip through the opening in the rail. The protruding member of the clip extends away from the main body of the clip at an angle of ninety degrees. The two bent edges of the clip are angled away from the main body of the clip at an angle of between twenty degrees and forty-five degrees, inclusive There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims.

BRIEF DESCRIPTION OF THE FIGURES

The accompanying drawings, which are incorporated in and form a part of this specification, illustrate embodiments of the invention and together with the description, serve to explain the principles of this invention.

DETAILED DESCRIPTION OF THE INVENTION

Figure 2:
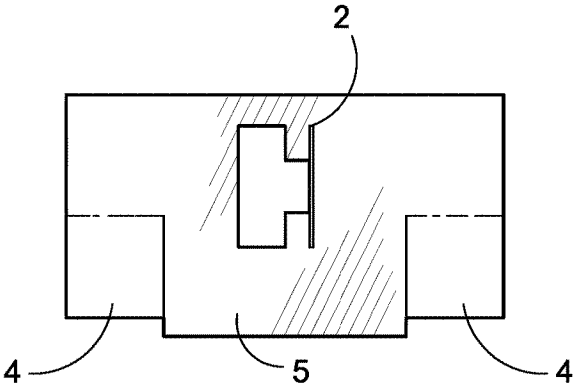
FIG. 2 is a back-elevation view of the clip of FIG. 1.
Figure 4:
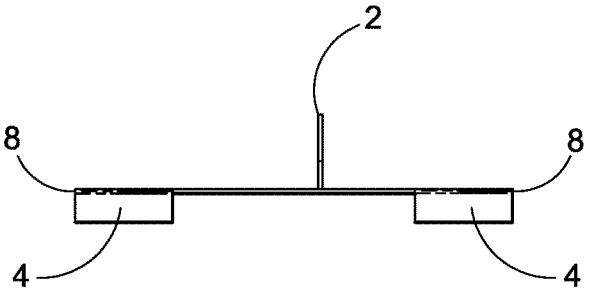
FIG. 4 is a top elevation view of the clip of FIG. 1.

Many aspects of the invention can be better understood with the references made to the drawings below. The components in the drawings are not necessarily drawn to scale. Instead, emphasis is placed upon clearly illustrating the components of the present invention. Moreover, like reference numerals designate corresponding parts through the several views in the drawings.

In one contemplated embodiment of the current invention, a single clip allows for extreme racking of a significant angle to the ground. Until now, such extreme racking was achieved by most of the prior art only through the use of extra wide stamping of existing stringers. The single clip according to the current invention also eliminates rattle and is more cost effective.

REFERENCE NUMBERS USED

1. Clip generally
2. T-Keeper
3. Base
4. Bent Edge
5. Flap
6. Top Edge
7. Bottom Edge
8. Side Edges
9. Picket generally
10. Rail generally
11. Picket Slot Cut
12. Rail side
13. Rail hole for picket
14. Anti-rattling force directions
15. Picket width
16. Rail lip
17. Pivoting Axis
18. Plane 1
19. Plane 2
20. T-Keeper Range of Motion
21. Pressure Directions
22. Dimple
23. Side of picket By way of introducing the subject matter of this description, it is very easy to build fences on flat ground. A contractor merely needs to buy enough "fence panels" to lay out a straight line of fence to do the job. In many circumstances, however, a fence must traverse an incline, or be racked. To achieve this, the pickets must extend up and through the stringer rails in a non-perpendicular fashion; in other words, the pickets must extend at an angle of less than or more than 90 degrees through the rail. When a fence is racked, such as when it traverses an incline, the pickets are angled relative to rails. However, the angling of the pickets relative to the rail requires a larger punched hole in the web of the rail. Smaller punched holes in the web of the rail are preferable. The smaller holes are more aesthetically pleasing and result in greater stability of the rail and overall fence.

While the prior art has several means by which this can be accomplished, the means often require external attachments, unsightly holes, and a rattling between the rails and the pickets due to loose connections. The current invention solves these problems by using the clip to create constant pressure between the pickets and rails, thereby allowing for effective racking of a fence without the "rattling" associated with most of the prior art.

Figure 1:
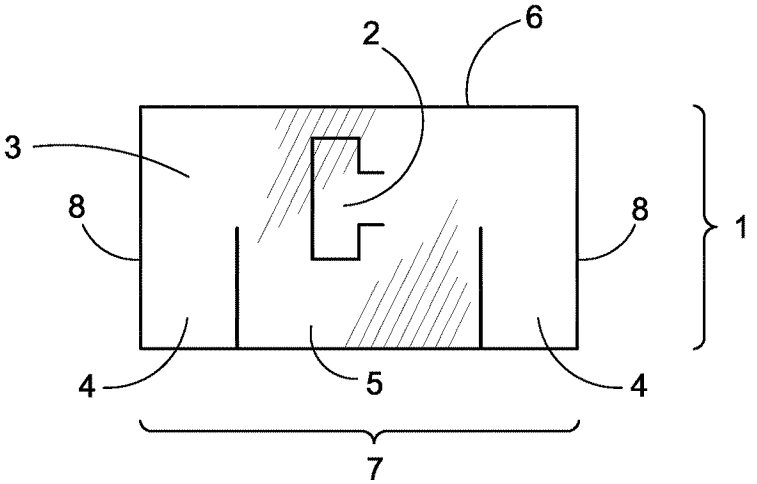
FIG. 1 is a front elevation view of a clip according to selected embodiments of the current disclosure.
Figure 3:
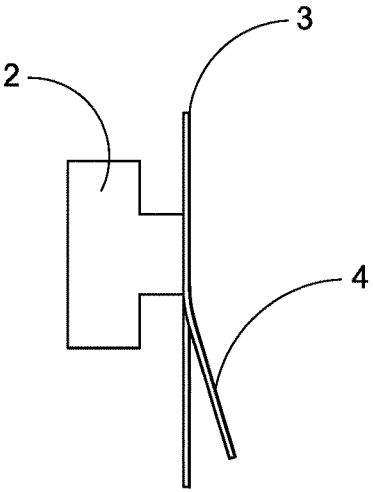
FIG. 3 is a side elevation view of the clip of FIG. 1.

FIGS. 1 through 4 are a series of drawings of the actual clip, showing its different parts. FIG. 1 is a front view of the clip, generally referenced as 1. The clip 1 has a top edge 6, a bottom edge 7, two side edges 8, and is roughly rectangular in shape, although embodiments with rounded edges are contemplated as well. The clip is made in this embodiment of sheet metal that is laser cut although other methods of manufacture are contemplated. In this embodiment, laser lines are cut such that the clip 1 is separated into several sub-regions: the T-Keeper, which is then bent up and serves to anchor the clip into the pivot, two bent edges 4, which are bent up and provide a constant force between the rail and the picket, and the base 3, which is the rest of the clip. The T-Keeper has a wide "head" portion, and a narrow "neck" portion. The wider head portion will later anchor the T-Keeper into a slot after the clip is turned sideways. The bent edges can be inclined at a variety of angles off the plane of the clip. In a particular embodiment, the bent edges are inclined at between 20 degrees and 45 degrees, inclusive, off the main body of the T-Keeper clip. In a further embodiment, the bent edges are inclined at between 25 degrees and 30 degrees. In another embodiment, the bent edges are inclined at 27.3 degrees.

Figure 7:
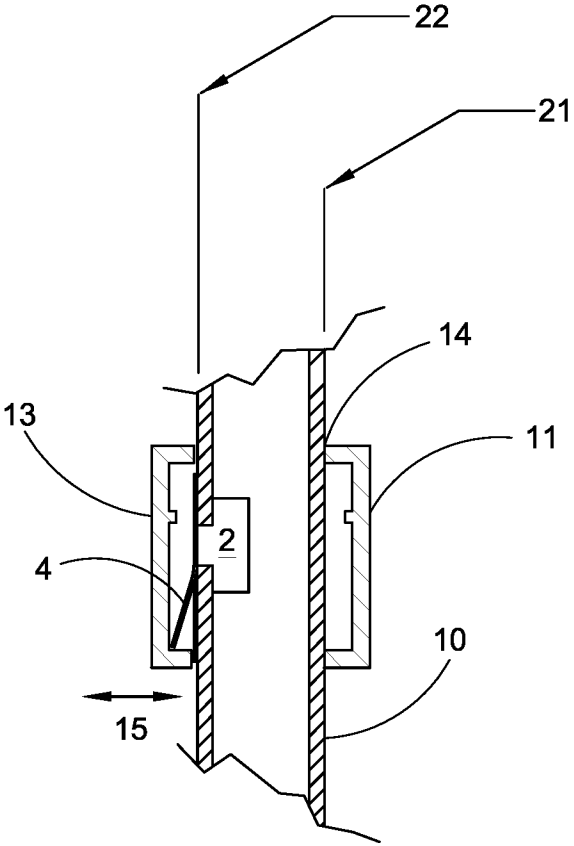
FIG. 7 is a cutaway side view of a portion of a picket, clip, and rail according to selected embodiments of the current disclosure.
Figure 6:
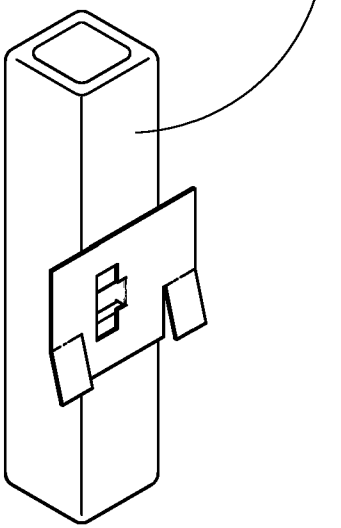
FIG. 6 is a perspective view of a portion of a picket with a clip according to selected embodiments of the current disclosure.
Figure 5:
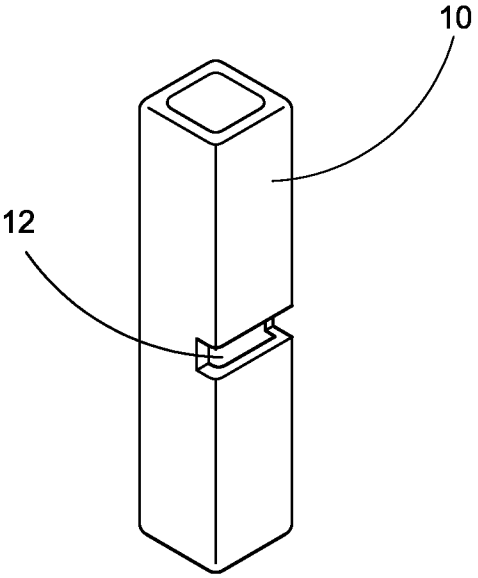
FIG. 5 is a perspective view of a portion of a picket according to selected embodiments of the current disclosure.

FIGS. 5 through 7 contain three drawings showing the clip attached to a picket, and the clip applying pressure internally against the inside of a rail. In FIG. 5, the picket 10 has had a notch, or picket slot cut 12 put into it at a location where a rail is going to be placed. It should be noted that making a relatively small picket slot cut into the picket is much less damaging to the overall strength of the fence panel than some of the prior art methods which involved larger removals of picket metal and/or drilling holes for screws, bolts, etc. The clip and method of using it also provides a substantial savings in terms of cost and time, as a large number of pickets can be lined up on the ground or a table to have the picket slot cut put into them at the same part of the picket. Many of the prior art attempts to solve this problem require individual holes to be drilled in each picket, which is much more time-consuming and costly in terms of human hours required to assemble the fence panel.

FIG. 7 shows the clip after having being inserted into the pocket slot cut on the picket 10 and turned 90 degrees so that the T-Keeper (not visible in this figure) has turned sideways and has "locked" the clip in place. FIG. 7 is a cross sectional view that shows the picket 10 after a rail 11 has been attached. The rail as a rail hole 14 in its top surface through which the picket is inserted. The rail has two sides 13 with outer and inner surfaces. The clip is retained in the picket slot cut by the T-Keeper 2. The bent edges 4 of the clip apply pressure against the inner surface of the raid side 13, keeping a constant pressure (in the direction shown by 15) between the picket and the rail. Because the ends of the bent edges 4 are flat, the resulting pressure is a plane from the ends of the two bent edges pushing against the flat plane of the inner wall of the rail. This allows the picket and rail to pivot around each other in two planes 21 and 22, and prevents the rattling sound that occurs when the picket and rail are not kept in place by constant pressure.

Figure 9:
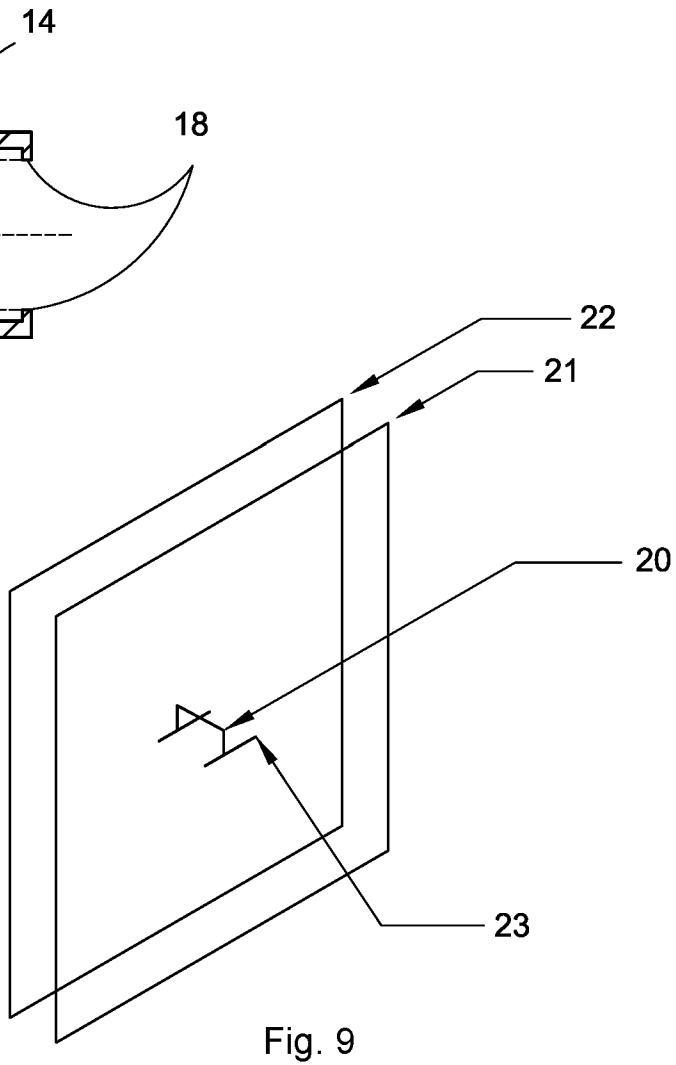
FIG. 9 is a diagram showing the pivoting axis and range of motion of a picket according to selected embodiments of the current disclosure.
Figure 8:
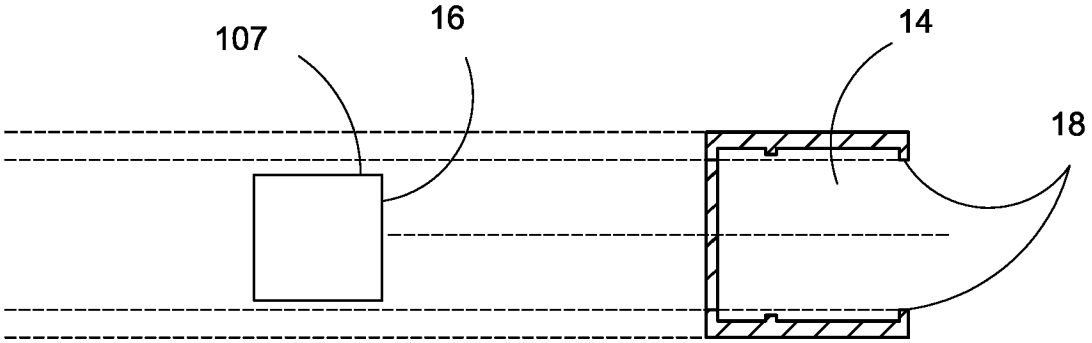
FIG. 8 is an exploded cutaway side view of how the rail has a rail hole through which the picket is pushed, according to selected embodiments of the current disclosure.
Figure 10:
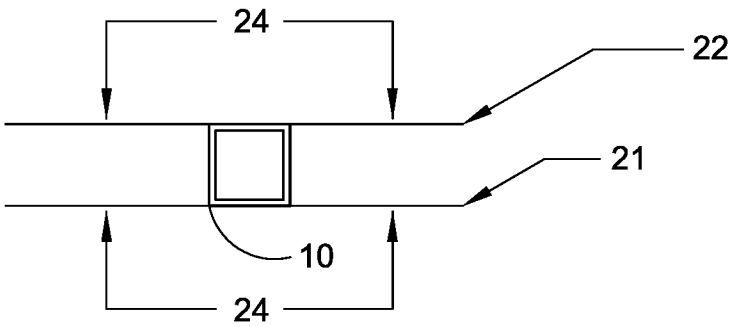
FIG. 10 is top elevation view of a picket according to selected embodiments of the current disclosure.
Figure 12A:
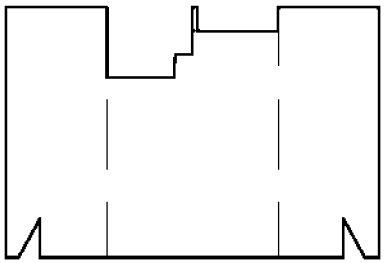
FIG. 12A is a front view of a notched clip according to selected embodiments of the current disclosure.
Figure 12B:
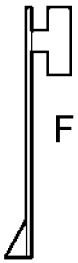
FIG. 12B is a side view of a notched clip according to selected embodiments of the current disclosure.
Figure 11:
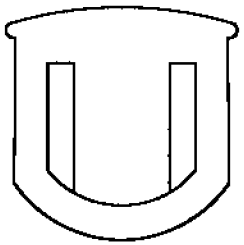
FIG. 11 is a front view of a clip according to selected embodiments of the current disclosure.

FIGS. 8 through 10 are a series of drawings showing another view of how the rotation without rattling is accomplished. FIG. 8 is an exploded view of how the rail has a rail hole 14 hole through which the picket is pushed. The rail hole is slightly wider than the picket width 16 (it should be noted that many pickets are square, such that the picket width 16 is the same as the picket length 107). The size and shape of the rail hole allows for the picket to pivot and the picket pivoting through the rail hole establishes two parallel planes (21 and 22 in FIG. 10) which are kept parallel by both the size and shape of the rail hole and the pressure 24 that the clip places from the picket to the inside surface of the rail. The T-Keeper keeps the clip in place, and, as shown in FIG. 9, the rail is forced by the pressure created by the bent edges of the clip to move around a pivoting axis 20, limited only by the T-Keeper range of motion 23, in two parallel planes 21 and 22.

FIGS. 8 through 10 are drawings also show how the rail has a hole through which the picket is pushed, and how the size and shape of the rail hole allows for the picket to pivot and how the picket pivoting through the rail hole establishes two parallel planes which are kept parallel by both the size and shape of the rail hole and the pressure that the clip places from the picket to the inside surface of the rail and how the rail is forced by the pressure created by the bent edges of the clip to move in two parallel planes.

With the prior art, the pivoting axis was some place other than the top of the rail, which required a larger hole through which the picket could rotate. With the current invention, the pivoting axis is at the top of the rail, which allows for a small pivot hole to be cut, making for a sturdier and more attractive fence.

Figure 13:
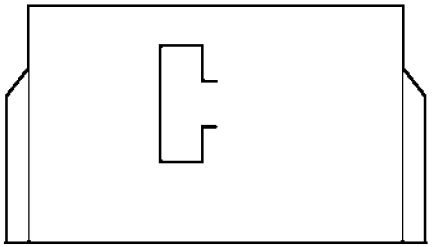
FIG. 13 is a front view of a clip with foldable edges according to selected embodiments of the current disclosure.
Figure 14:
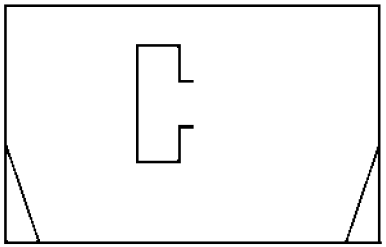
FIG. 14 is a front view of another clip with foldable edges according to selected embodiments of the current disclosure.

FIGS. 11 through 14 are front views showing some prior prototypes of the clip, which are also considered to be part of this invention and are not intended to be limiting in any manner. Among the other versions of the clip are a rounded version (FIG. 11), a notched version (FIGS. 12A and 12B), and two versions with foldable edges (FIGS. 13 and 14).

Figure 15:
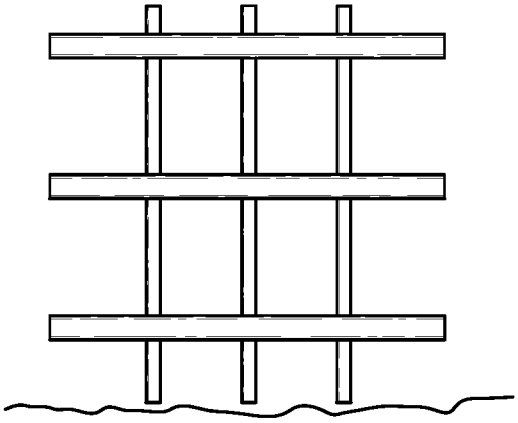
FIG. 15 is a front view showing a fence constructed on flat ground.
Figure 16:
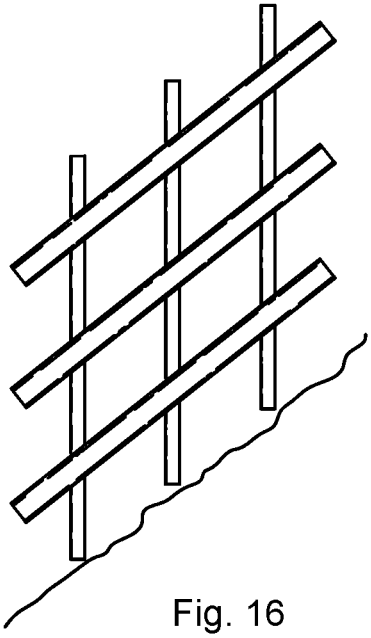
FIG. 16 is a front view of a fence constructed on an upward slope.
Figure 17:
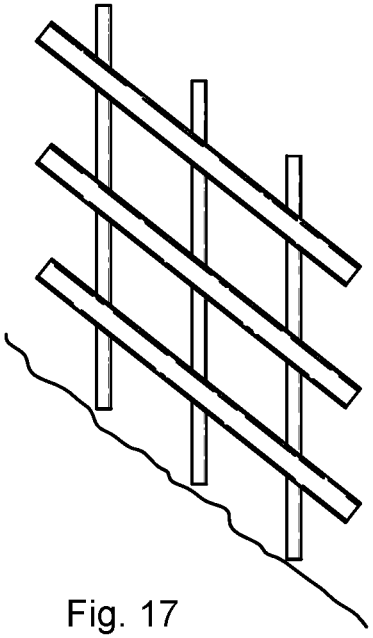
FIG. 17 is a front view of a fence constructed on a downward slope.

FIGS. 15 through 17 are front views showing how this invention allows a fence to be constructed on flat ground (FIG. 15) or on sloped ground where the fence is "racked" (FIGS. 16 and 17).

Figure 18:
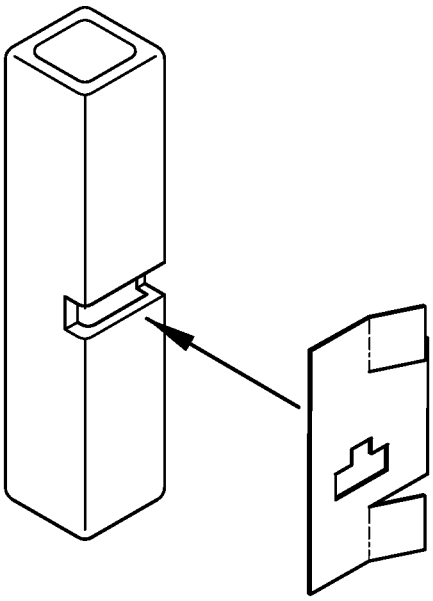
FIG. 18 is an exploded perspective view of a portion of a picket and a clip according to selected embodiments of the current disclosure.
Figure 19:
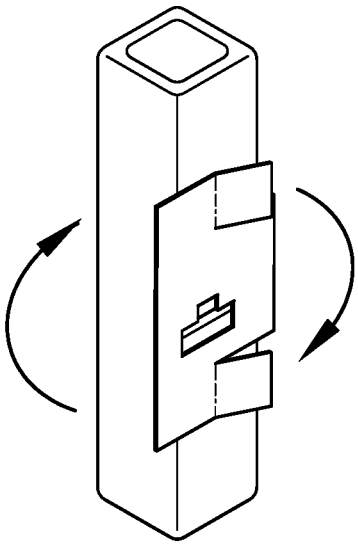
FIG. 19 is a perspective view of a portion of a picket with an un-rotated clip according to selected embodiments of the current disclosure.
Figure 20:
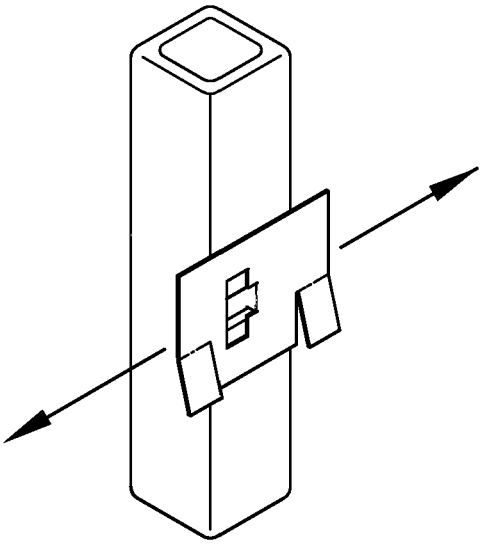
FIG. 20 is a perspective view of a portion of a picket with a rotated clip according to selected embodiments of the current disclosure.

FIGS. 18 through 20 are perspective views showing how the clip is inserted into the picket slot cut and rotated, thereby not only locking it into place, but also allowing the clip to move back and forth in the picket slot cut, thereby allowing for a smoother and more efficient racking of a fence panel. As can be seen, once the T-Keeper is inserted into the picket slot cut, it can be turned 90 degrees. Because the T-Keeper is much longer at its top than at the narrower "neck", once it has been turned, the "neck" has a very long range of motion within the picket slot cut. Thus, once the clip has locked onto a rail, the rail can be rotated up or down and will carry the clip with it.

The clip discussed herein may also be used with a rail that has no hole in its web. For example, a rail may be located at the top of the fence panel, wherein the pickets extend up to, but not through the rail. In such a configuration, the picket slot cut or picket slot punch is located near the end of the picket, such that the inserted clip restrains the top of the picket within the rail, but does not extend through the web of the rail.

Some embodiments of the current disclosure provide for a clip that includes one or more dimples on its base. The dimples are rounded protrusions that extend away from the base of the clip. When the clip is mated with the picket, as discussed in more detail below, the dimples extend toward the picket and apply a force that pushes the clip away from the picket. Accordingly, the dimples extend away from the base in a direction opposite of the bent edges. This perpendicular pressure would push the clip away from the picket but for the head of the T-Keeper that provides an opposite restraining force. The dimples provide for a smooth installation and removal of the clip, if required, with little to no scratching of the coating or other surface of the picket.

Figure 21:
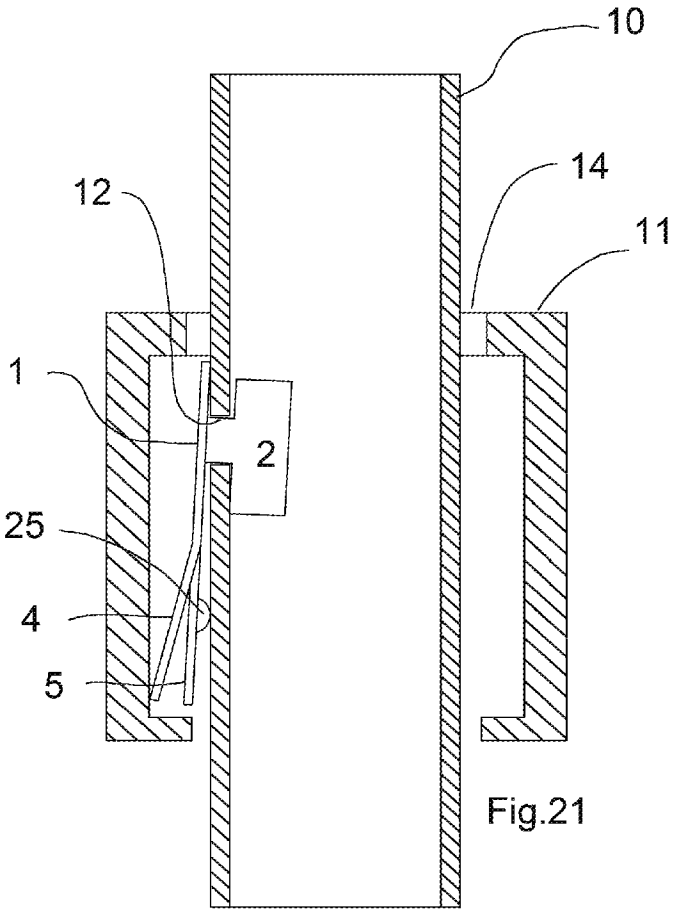
FIG. 21 is a cutaway side view of a clip, picket, and rail according to selected embodiments of the current disclosure.

FIG. 21 is a cutaway side view of a clip, picket, and rail according to selected embodiments of the current disclosure. A picket 10 extends through a rail hole 14 in a rail 11. A clip 1 is secured through a picket slot cut 12 of the picket by a T-Keeper 2. A bent edge 4 is adjacent to and pushes against the side of the rail 11. A flap 5 of the base of the clip 1 includes a dimple 25. The dimple extends towards and pushes against the side of the picket 10. Thus, the clip 1 provides a force that pushes the inside of the rail 11 away from the outside of the picket 10.

Figure 22:
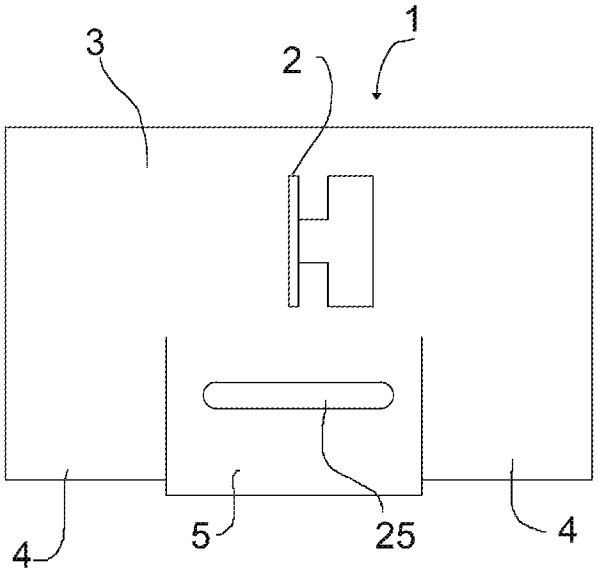
FIG. 22 is a back-elevation view of a clip with a dimple according to selected embodiments of the current disclosure.

FIG. 22 is a back-elevation view of a clip with a dimple according to selected embodiments of the current disclosure. A clip 1 has a T-Keeper 2 that extends away from the base 3. A flap 5 between two bent edges 4 includes a dimple 25. The dimple 25 has a length that is greater than its width. Particular embodiments provide for a dimple that is at least twice the length of its width. Other embodiments provide for a dimple that is at least four times its width. The length of the dimple extends between the two bent edges 4.

The dimple or embossment of the clip creates a holding pressure between the clip and the picket. The dimple pushes the body of the clip away from the picket, while the T-Keeper provides an opposite force that pulls the clip towards the picket, thereby increasing rigidity and reducing, if not eliminating, rattling. As shown in FIG. 21, the dimple also displaces the surface of the clip base away from the picket to prevent damages to the powder coat during both installation and use. The smooth transition of the dimple avoids sharp edges that may come in contact with the picket. The picket movement is against the dimple as opposed to the entire base, thereby minimizing the surface area in contact between the two components, which results in less friction and smoother movement when the two components are rotated or moved relative to each other. Furthermore, the dimple is positioned close enough to the top of the clip such that any damage to the picket caused by contact between the dimple and the picket is hidden once the clip is secured to the picket and within the rail.

In other embodiments, the two bent edges 4 are instead one or more dimples. The dimples are rounded protrusions that extend away from the base of the clip. Like the bent edges, the dimples provide a constant force between the rail and the picket.

Figure 23A:
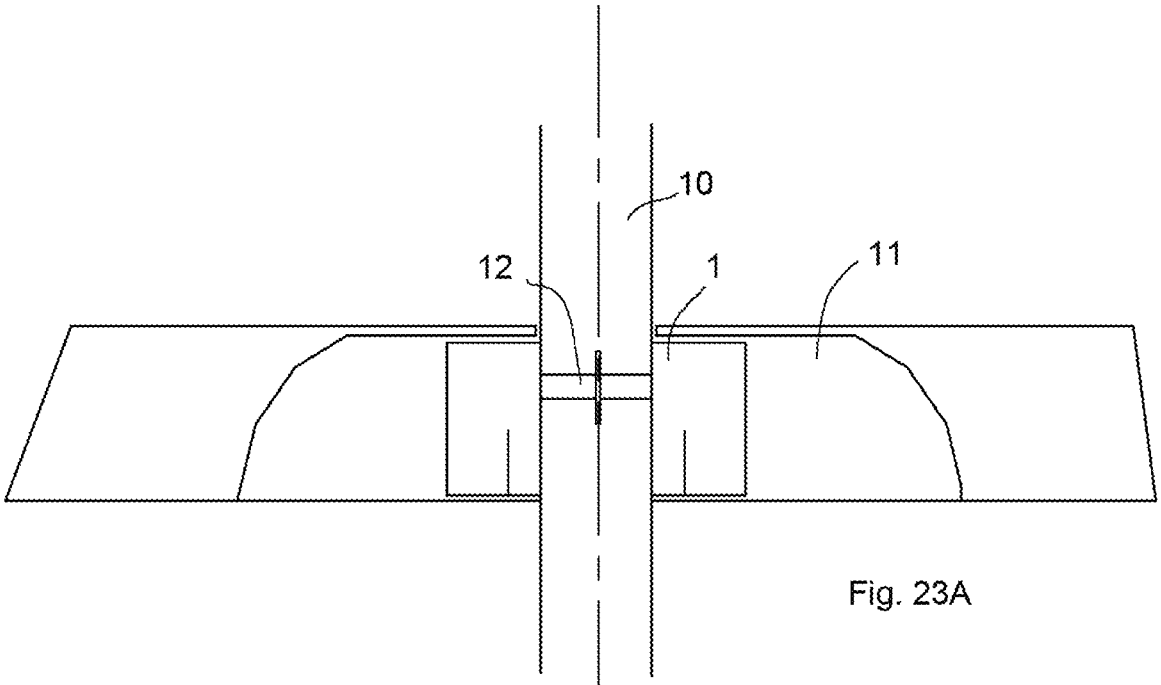
FIG. 23A, FIG. 23B, and FIG. 23C show the rackability of a picket using a clip in a rail according to selected embodiments of the current disclosure.
Figure 23B:
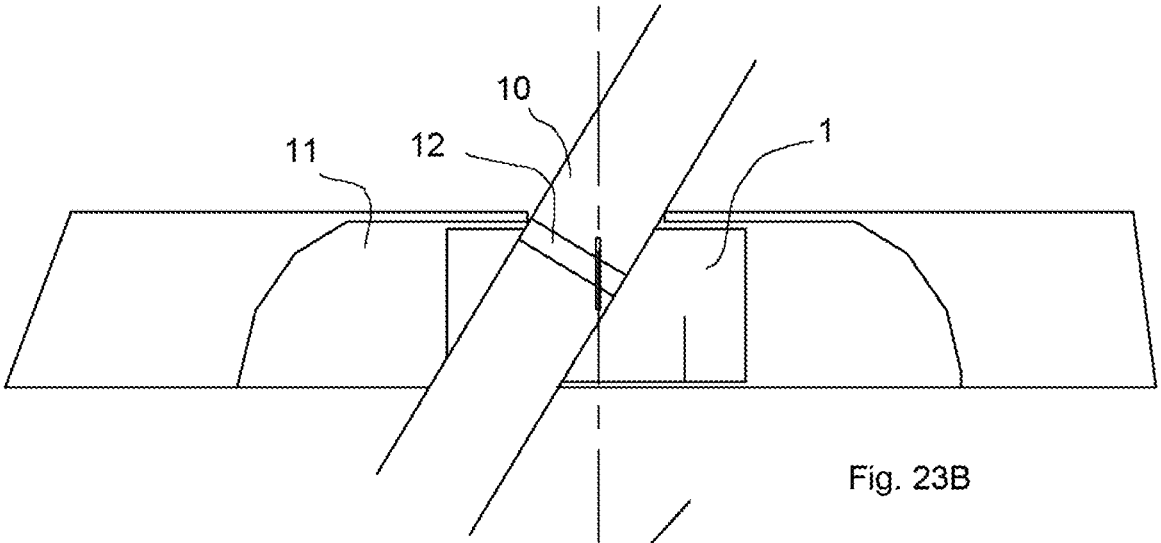
Figure 23C:
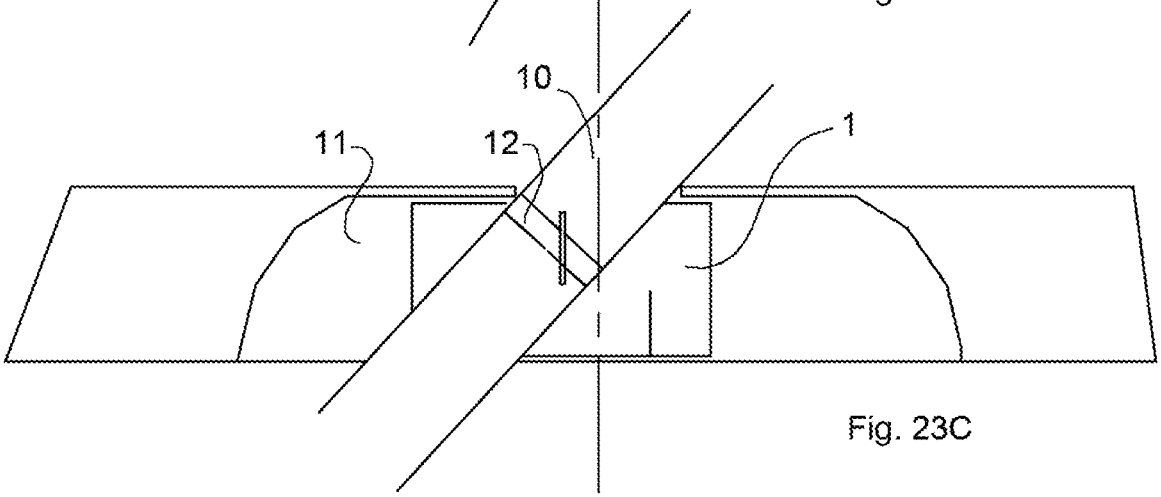

FIG. 23A, FIG. 23B, and FIG. 23C show the rackability of a picket using a clip in a rail according to selected embodiments of the current disclosure. FIG. 23A shows a picket 10 passing through a rail 11 at approximately a ninety-degree angle; in other words, perpendicularly. The picket 10 includes a picket slot cut 12 through which extends the T-Keeper of the clip 1. The clip 1 is shown centered about the centerline of the opening in the rail 11, as well as in the center of the picket slot cut 12. FIG. 23B shows a picket 10 passing through the rail 11 at an angle. The picket 10 includes a picket slot cut 12 through which extends the T-Keeper of the clip 1. The clip 1 is shown centered about the center line of the opening in the rail. However, the T-Keeper is off-center from the centerline of the picket. FIG. 23C shows a picket 10 passing through the rail 11 at a greater angle than that shown in FIG. 23B. The picket 10 includes a picket slot cut 12 through which extends the T-Keeper of the clip 1. The clip 1 is shown off-center from the center line of the opening in the rail. Additionally, the T-Keeper is off-center from the centerline of the picket. Thus, these figures show how the clip may slide and rotate relative to the picket within the picket slot cut, as well as how the clip may slide within the rail. The travel of the clip along the length of the rail allows the pivot point of the picket to shift. These features provide for a fence panel that racks to a significant angle while at the same time providing for a rigid, rattle resistant frame.

While the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What is claimed is:

1. A fence panel comprising a rail, where the rail comprises two sides and a top web, where the top web additionally comprises a rail hole, at least one of the two sides additionally comprises a lip, and where the two sides each have an outer surface and an inner surface;

a picket, where the picket has a picket length and a picket width, and additionally comprising a picket slot cut;

a clip, where the clip comprises a main body, a protruding member, and two bent edges, where the protruding member has a narrow neck portion and a wide head portion, where the protruding member is secured to the main body by its neck portion; where the two bent edges are attached to a bottom portion of the main body;

where the protruding member of the clip mates with the picket slot cut, where the picket is pushed through the rail hole such that the progress of the picket is stopped by the top edge of the clip, and where the bent edges of the clip exert an amount of pressure against an inner surface of the rail, whereby the picket slot cut provides for the clip being able to slide inside the picket thereby allowing a focal point of picket rotation to change position along an axis of the rail.

2. The fence panel of claim 1, further comprising a plurality of additional pickets and a plurality of additional clips, where each of the plurality of additional pickets is identical to the picket, where each of the plurality of additional clips is identical to the clip, and the plurality of additional pickets is secured to the rail by the plurality of additional clips.

3. The fence panel of claim 1, further comprising two posts, where each end of the rail is secured to one of the two posts.

4. The fence panel of claim 1, wherein the protruding member of the clip extends away from the main body of the clip at an angle of ninety degrees.

5. The fence panel of claim 1, wherein the head portion of the protruding member has a width that is at least twice a width of the neck portion.

6. The fence panel of claim 1, wherein the two bent edges of the clip are angled away from the main body of the clip at an angle of between twenty degrees and forty-five degrees, inclusive.

7. The fence panel of claim 1, wherein the two bent edges of the clip are angled away from the main body of the clip at 27.3 degrees.

8. A method of securing a picket to a rail comprising the steps of inserting a protruding member of a clip into a picket slot cut of the picket, wherein the picket slot cut has a length, where the clip comprises a main body, the protruding member, and two bent edges, where the protruding member has a narrow neck portion and a wide head portion, where the protruding member of the clip slides along the length of the picket slot cut, where the protruding member is secured to the main body by its neck portion; where the two bent edges are attached to a bottom portion of the main body;

rotating the clip; and pushing the picket and the clip through an opening in the rail.

9. A method of securing a picket to a rail comprising the steps of inserting a protruding member of a clip into a picket slot cut of the picket, wherein the rail has a length, wherein the picket slot cut has a length, where the clip comprises a main body, the protruding member, and two bent edges, where the protruding member has a narrow neck portion and a wide head portion, where the clip slides along the length of the rail, where the protruding member is secured to the main body by its neck portion, where the two bent edges are attached to a bottom portion of the main body, where the protruding member of the clip slides along the length of the picket slot cut, whereby the picket is allowed to rotate relative to the rail;

rotating the clip; and pushing the picket and the clip through an opening in the rail.

* * * * *